United States Patent [19]

Blakeslee

[11] 4,182,126

[45] Jan. 8, 1980

[54] FORK LIFT HYDRAULIC SERVO CONTROL VALVE

[75] Inventor: Thomas R. Blakeslee, Woodside, Calif.

[73] Assignee: Logisticon, Inc., Sunnyvale, Calif.

[21] Appl. No.: 941,028

[22] Filed: Sep. 11, 1978

[51] Int. Cl.[2] ..... F15B 15/22

[52] U.S. Cl. ..... 60/459; 60/468; 60/477; 91/392

[58] Field of Search ..... 91/20, 392, 400, 459; 60/459, 468, 477, 494

[56] References Cited

U.S. PATENT DOCUMENTS

| | | | |
|---|---|---|---|
| 453,980 | 6/1891 | Matthews | 91/358 A |
| 817,691 | 4/1906 | Brandt | 91/20 |
| 959,786 | 5/1910 | Neal | 91/358 R X |
| 2,359,112 | 9/1944 | Hymans | 187/28 |
| 3,570,243 | 3/1971 | Comer et al. | 60/431 |
| 4,062,269 | 12/1977 | Chichester | 91/400 |

*Primary Examiner*—Edgar W. Geoghegan

[57] ABSTRACT

A servo controlled, proportional valve is connected in parallel with a forklift truck control valve to regulate the speed at which the fork is raised or lowered by shunting the forklift pump output to the hydraulic fluid reservoir during the raising of the fork and by restricting the return flow of fluid from the lift jack during lowering of the fork with the setting of the proportional control valve being servo controlled in response to a fork height sensor.

4 Claims, 1 Drawing Figure

FORK LIFT HYDRAULIC SERVO CONTROL VALVE

BACKGROUND OF THE INVENTION

This invention relates to a lift jack control system and more particularly to a servo control for regulating the operation of a fork lift jack.

In manually controlled or semi-automatically controlled forklift operations the forklift raises the fork, usually by means of a hydraulic jack, to some desired height at which point the forklift jack is stopped. Because the fork may be carrying heavy loads it is necessary to slow the rate of ascent or descent of the fork shortly before the desired stopping point. If this is not done the fork may come to an abrupt halt which can upset the load or damage the forklift due to the inertia of the load and the fork.

In some prior control systems this is accomplished by automatically slowing the fork to some predetermined constant speed approximately one foot before the desired stopping point. This can produce lengthy delays in the final fork positioning and can greatly reduce the efficiency of any automatic or semi-automatic order picking system using such a forklift.

Still another disadvantage of some prior art forklift positioning control systems is that the raising and lowering of the forklift is operated automatically without being initiated by the operator. In some circumstances this can pose a danger to the operator and to bystanders due to unexpected movement and is a special problem because such systems can also get out of control.

SUMMARY OF THE INVENTION

The above and other disadvantages of prior art forklift systems are overcome by the present improvement to the control system for a manually activated, fluid operated lift jack, such as used in a forklift, of the type which includes a fluid tank, a pump having an inlet connected to the tank and an outlet, and a manually activated control valve connected between the jack, the pump outlet and a tank return line. In this conventional type of control system the control valve is operated to either supply fluid under pressure from the pump to the jack to cause it to extend or to return fluid from the jack to the tank via the return line to cause the jack to retract.

The improvement comprises a proportional valve which is connected between the pump outlet, the tank and the tank return line and the manual control valve. This valve provides proportional fluid communication either between the pump outlet and the tank return line or between the truck control valve and the tank return line so that the speed at which the lift jack is retracted or extended can thereby be controlled. When the lift jack is being extended the proportional valve causes a portion of the fluid under pressure from the pump outlet to be bypassed directly to the tank return line, thereby decreasing the fluid pressure available to cause the lift jack to extend which, in turn, reduces the rate of speed at which the lift jack is extended. In retracting the lift jack, the proportional valve restricts the flow of fluid from the truck's control valve to the tank return line, thereby slowing the rate of descent of the lift jack.

Means are also included for sensing the amount by which the lift jack is extended and for producing a first control signal which represents that amount. A motor is used to adjust the setting of the proportional valve and means are also provided for sensing at least one limit position of the proportional valve and for supplying a second control signal when the limit is reached. A selector switch is provided for selectively generating a third control signal representative of the desired final position of the lift jack.

A servo control circuit is connected to the two sensors and the selector switch so that the circuit is supplied with the first, second and third control signals. The servo control circuit is connected to operate the valve setting motor in response to these control signals in a manner such that the speed of the lift jack in extending and retracting is proportional to the distance remaining between the actual amount of extension and the desired amount of extension indicated by the selector switch. The valve setting motor is a stepper motor. The servo control circuit includes a micro-computer and stepper motor power drivers connected etween the micro-computer and the stepper motor for converting the output signals from the micro-computer into driving signals for the stepper motor. The micro-computer is programmed to control the proportional valve position through the motor in accordance with the following formula:

$$V=A-|Y_f-Y_n|+LG[B(Y_n-Y_{n-1})-|Y_f-Y_n|+C]$$

where:

V = valve position

A = a constant representative of the closing point of the valve $Y_n$ = present amount of lift jack extension $Y_f$ = desired amount of lift jack extension LG = overall loop gain of the servo control means B = a constant representing the desired velocity curve profile for the lift jack, i.e., that the velocity be proportional to the remaining distance to the selected shelf height by a certain factor. For example, at 3" of remaining distance, the desired velocity should be 1"/sec., and C = a selected constant representative of a predetermined distance beyond the desired amount of extension in order to prevent the equation from becoming asymptotic.

In this way the rate of travel of the fork is gradually slowed as the fork approaches the heiht selected by the operator with the selector switch.

It is therefore an object of the present invention to provide a forklift control system for smooth and rapid forklift positioning.

It is another object of the invention to provide a forklift control system which requires initiation by a manual operator and overrides the manual control in slowing the rate of travel of the fork.

It is still another object of the invention to provide a forklift positioning control system which automatically controls the speed of the forklift extension or retraction as a function of the distance between the actual forklift position and the desired position.

The foregoing and other objectives, features and advantages of the invention will be more readily understood upon consideration of the following detailed description of certain preferred embodiments of the invention, taken in conjunction with the accompanying drawings.

DESCRIPTION OF THE PREFERRED EMBODIMENT

Figure 1:
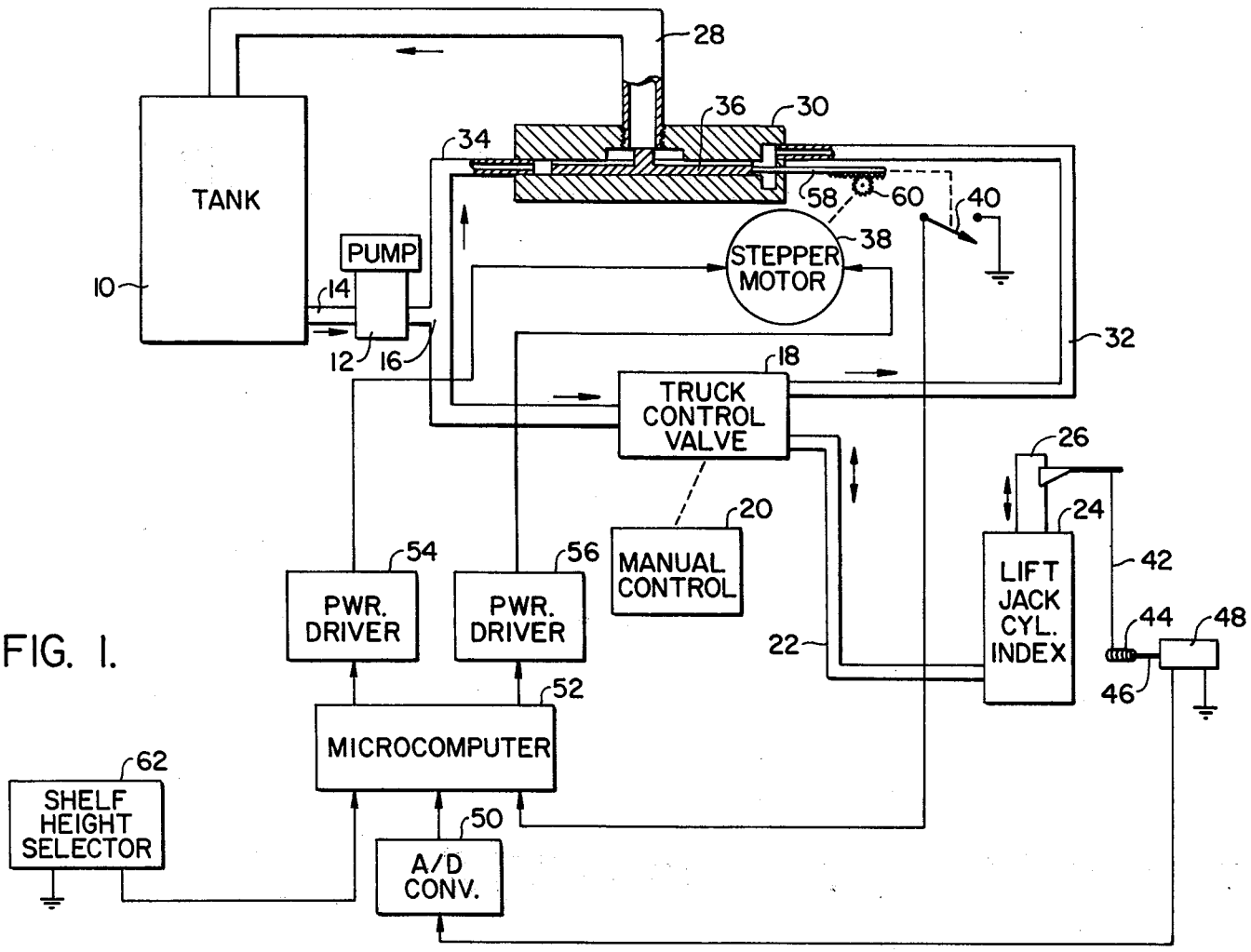
FIG. 1 is a block diagram of the forlift control system according to the preferred embodiment of the invention.

Referring now more particularly to FIG. 1, a basically conventional system is illustrated together with the improvement of the invention. The conventional portion includes a tank 10 containing a fluid, such as a hydraulic fluid, which is connected to the inlet of a pump 12 by means of a pipe 14. The outlet of the pump 12 is connected through a tee connection to the pressure side of a conventional truck control valve 18 which is operated under manual control 20. The truck control valve 18 is connected by means of a pipe 22 to the lift jack cylinder 24 of a forklift (not shown). A hydraulic ram 26 is extended from the lift jack cylinder 24 when it is receiving hydraulic fluid under pressure from the pump 12 through the control valve 18. In a conventional configuration the truck control valve would normally be connected directly through a tank return line 28 to the tank 10. The hydraulic ram 26 is lowered by causing the truck control valve 18 to be positioned such that fluid can escape from the cylinder 24 through the line 22 and the tank return line 28. The pump is automatically shut off by means of a switch attached to the manual control 20.

In the improved control system of the present invention, however, the truck control valve 18 is connected to the tank return line 28 through a proportional valve 30 by means of a pipe 32. The valve 30 is also connected at a separate input to the outlet of the pump 12 by means of a pipe 34. The position of a sliding valve element 36 within the control valve 30 is controlled by means of a stepper motor 38 and gear arrangement. A limit position of the sliding element 36 is sensed by a switch 40.

When the sliding element 36 is positioned in an extreme right-hand position as viewed in FIG. 1, the pressurized fluid from the outlet of the pump 12 bypasses the truck control valve 18 and the lift jack cylinder 24 and is shunted directly through the pipe 34 and the valve 30 to the tank return line 28. When the sliding element 36 is in the extreme left hand position as viewed in FIG. 1, the fluid flow from the truck control valve 18 through the pipe 32 to the tank return line 28 is essentially unrestricted. At settings inbetween these two extreme positions, either some of the pressurized fluid from the outlet of the pump 12 is shunted to the tank return line 28 or the fluid return path from the lift jack cylinder 24 is restricted by the valve 30, depending on whether the lift jack cylinder is being extended or retracted, respectively. By thus controlling how much fluid is bypassed to the tank or restricted in the return flow path, the speed at which the lift jack cylinder is extended or retracted is also controlled.

In order to control the speed of the lift jack cylinder's extention or retraction as a function of its height, a wire 42 is attached at one end to the top of the lift ram 26. The other end of the wire 42 is wrapped around a drum 44. The drum 44 is spring biased to hold the wire taut by rotating to take up any slack in the wire. The axle 46 of the drum 44 is connected to rotate a potentiometer 48.

The potentiometer 48 is electrically connected between the circuit ground and the input of an analog to digital converter 50 whose output is supplied to one input of a micro-computer 52. Two outputs from the micro-computer go to separate power driver circuits 54 and 56 whose outputs are supplied to the stepper motor 38. By controlling the relative phases of the output signals which are supplied to the power drivers 54 and 56 the micro-computer 52 can determine the direction of rotation of the stepper motor 38 and thus whether the sliding valve element 36 bypasses the pump outlet to the tank return line 28 or restricts the return flow of fluid from the lift jack cylinder 24 to the tank return line 28.

The stepper motor controls the movement of the sliding element 36 by means of an extension 58 attached to it which projects from the body of the valve 30. The motor moves the extension 58 by a rack and pinion gear assembly 60. The limit switch 40 is attached to the extension 58 so that it closes when the sliding element 36 is in the extreme left-hand position, as is FIG. 1.

In operation, the forklift driver moves the manual control 20 to set the main valve 18 to either raise or retract the ram 26 within the lift jack cylinder 24. Assuming that the operator is attempting to raise the ram 26, the control valve 18 is operated in such a manner that the pressurized fluid from the outlet of the pump 12 is supplied to the lift jack cylinder 24 through the truck control valve 18. As the ram 26 extends from the cylinder 24, the end of the wire 42 is pulled along with it. This rotates the drum 44 and continuously produces a first analog control signal from the potentiometer 48 to the micro-computer which is representative of the height, that is the amount of extension, of the ram 26. The operator also inputs to the micro-computer 52 the particular shelf height at which the hydraulic ram 26 is to stop by means of a shelf height selector switch 62 which can directly feed a digital signal to the micro-computer 52. With the initial operation of the truck control valve 18 by the manual control 20 the micro-computer 52 causes the sliding element 36 of the valve 30 to go to the extreme left-hand position, thereby closing the limit switch 40. The limit switch 40 provides still another input to the micro-computer 52 so that the micro-computer, from that point forward, can determine the position of the sliding element 36 by remembering by how much the stepper motor 38 has been advanced. As the ram 26 extends upwardly the micro-computer 52 compares the signal from the potentiometer 48 against the input signal from the shelf height selector switch 62 to determine how far the ram 26 has to travel to reach the desired height. Knowing this distance the micro-computer then causes the stepper motor 38 to position the sliding element 36 to partially shunt the pump outlet directly to the tank return line 28 according to the following formula:

$$V=A-Y_f-Y_n+LG\,[B(Y_n-Y_{n-1})-Y_f-Y_n+C]$$

where:

- V = valve position
- A = a constant which is representative of the closing point of the valve
- $Y_n$ = present amount of lift jack extension
- $Y_f$ = desired amount of lift jack extension
- LG = overall loop gain of the servo control means
- B = a constant representing the desired velocity curve profile for the lift jack, i.e., that the velocity be proportional to the remaining distance to the selected shelf height by a certain factor. For example, at 3" of remaining distance the desired velocity should be 1"/sec., and C = a selected constant representative of a predetermined distance beyond the desired amount of extension in order to prevent the equation from becoming asymptotic.

Utilizing this program the micro-computer 52 thus controls the speed at which the ram 26 is raised in proportion to the distance remaining to the desired shelf height or stopping point for the ram 26. Similarly, when the truck control valve 18 is manipulated by the manual control 20 to lower the ram 26 the micro-computer senses the change in value of the potentiometer 48 and compares it against the inputed shelf height from the selector switch 62. Utilizing the above formula the micro-computer, through the power drivers 54 and 56 and the stepper motor 38, moves the sliding element 36 to the right, as viewed in FIG. 1, to restrict the return flow of fluid from the lift jack cylinder 24 to the tank return line 38, and thereby controls the rate of descent of the ram 26 as a function of the distance remaining to the desired stopping point.

Thus it can be seen that the lift jack is operated under manual control for the greater proportion of its extension or retraction. Shortly before it reaches the desired height, however, the servo control system of the invention automatically slows the rate of travel of the ram 26 to bring the ram to a smooth stop at the desired height with relatively good accuracy but without an unnecessary waste of time in completing the fork positioning. While in the above described embodiment the lift jack cylinder 24 and ram 26 have been referred to as operating in a vertical direction, it should by apparent that the system would apply to a lift jack cylinder and ram operating in any orientation. Furthermore, the system of the invention overrides the operator's manual control only to the extent that the operator is unable to force the ram 26 to retract or extend at a speed beyond that which is allowed by the servo control system. The servo control system, on the other hand, cannot unilaterally cause the ram 26 to extend to retract without the simultaneous operation of the manual control 20 by the operator. This adds an inherent safety feature to the system.

In the above description the micro-computer 52 has not been described in detail since such devices are well known to those skilled in the art. By way of example, however, a suitable micro-computer would be an Intel Model 8748 or Motorola Model 6801.

The terms and expressions which have been employed here are used as terms of description and not of limitations, and there is no intention, in the use of such terms and expressions of excluding equivalents of the features shown and described, or portions thereof, it being recognized that various modifications are possible within the scope of the invention claimed.

What is claimed is:

1. An improved control system for a manually activated, fluid operated lift jack of the type having a fluid tank, a tank return line, a pump having an inlet connected to the tank and an outlet, and a manually activated control valve connected between the jack, the pump outlet and the tank return line to either supply fluid under pressure from the pump to the jack to cause it to extend, or to return fluid from the jack to the tank return line to cause the jack to retract, all at an operator's election, and wherein the improvement comprises a proportional valve connected between the pump outlet, the tank, and the tank return line to provide selective proportional fluid communication between the truck's control valve and the tank return line whereby the speed at which the lift jack is retracted and extended is controlled by the setting of the proportional valve by bypassing a portion of the fluid under pressure from the pump outlet to the tank return line in extending the jack and restricting the flow of fluid from the truck's control valve to the tank return line in retracting the jack.

2. An improved lift jack control system as recited in claim 1 wherein the improvement further comprises servo means sensitive to the amount of extension of the lift jack for automatically controlling the setting of the proportional valve as a function of the distance between the actual amount of extension of the lift jack and a preselected amount of extension.

3. An improved lift jack control system as recited in claim 1 wherein the improvement further comprises means for sensing the amount by which the lift jack is extended and for producing a first control signal which is representative of the sensed amount of extension, motor means for adjusting the setting of the proportional valve, means for sensing at least one limit position of the proportional valve and for supplying a second control signal when the limit is reached, switch means for selectively generating a third control signal which is representative of a desired extension of the lift jack and servo control means supplied with the first, second and third control signals and connected to operate the valve setting motor means in response to the first, second and third control signals whereby the speed of the lift jack in extending and retracting is proportional to the distance remaining between its actual amount of extension and the desired amount of extension.

4. An improved lift jack control system as recited in claim 3 wherein the motor means include a stepper motor and the servo control means include a micro-computer, stepper motor power driver means connected between the micro-computer and the stepper motor and wherein the micro-computer is programmed to control the proportional valve setting through the motor means in accordance with the formula:

$$V = A - Y_f - Y_n + LG\,[B(Y_n - Y_{n-1}) - Y_f - Y_n + C]$$

where:

V = valve position

A = a constant which is representative of the closing point of the valve $Y_n$ = present amount of lift jack extension $Y_f$ = desired amount of lift jack extension LG = overall loop gain of the servo control means B = a constant representing the desired velocity curve profile for the lift jack, i.e., that the velocity be proportional to the remaining distance to the selected shelf height by a certain factor. For example, at 3" of remaining distance the desired velocity should be 1"/sec., and C = a selected constant representative of a predetermined distance beyond the desired amount of extension in order to prevent the equation from becoming asymptotic.

* * * * *